US008220369B2

(12) United States Patent
Lai

(10) Patent No.: US 8,220,369 B2
(45) Date of Patent: Jul. 17, 2012

(54) TORQUE ADJUSTABLE SLEEVE ASSEMBLY

(76) Inventor: Jin-Tsai Lai, Taichung (TW)

( * ) Notice: Subject to any disclaimer, the term of this patent is extended or adjusted under 35 U.S.C. 154(b) by 463 days.

(21) Appl. No.: 12/556,574

(22) Filed: Sep. 10, 2009

(65) Prior Publication Data

US 2011/0056341 A1 Mar. 10, 2011

(51) Int. Cl.
*B25B 23/157* (2006.01)

(52) U.S. Cl. ..... 81/475; 81/471; 81/476

(58) Field of Classification Search ..... 81/471, 81/475, 476

See application file for complete search history.

(56) References Cited

U.S. PATENT DOCUMENTS 3,906,819 A * 9/1975 Curtis ..... 81/475
6,640,674 B1 * 11/2003 Rinner et al. ..... 81/475

* cited by examiner

*Primary Examiner* — Joseph J Hail
*Assistant Examiner* — Shantese McDonald

(57) ABSTRACT

A torque adjustable sleeve assembly includes a first part with first teeth in the first end thereof and a second part has one end inserted into the first end of the first part. The second part includes second teeth which are engaged with the first teeth. A rod passes through the first and second parts and two springs are mounted to the rod and located in the two parts respectively. A movable member is threadedly connected to an end of the rod and adjusts the compression of the two springs to adjust an engaging force between the first and second teeth. The second part includes a driving hole to be connected with a tool bit or screw unit. The second part is made of plastic material so as to protect the tool bit or the screw unit to be tightened or loosened.

6 Claims, 7 Drawing Sheets

TORQUE ADJUSTABLE SLEEVE ASSEMBLY

BACKGROUND OF THE INVENTION

1. Field of the Invention

The present invention relates to a sleeve assembly, and more particularly, to a torque adjustable sleeve assembly.

2. Description of Related Art

A conventional torque adjustable assembly known to applicant generally includes a torque adjustable device received in the assembly, a transmission device and a driving member, wherein the torque adjustable device compresses the spring in the assembly so as to adjust the force that the torque sleeve assembly applied to the object to be tightened. The torque adjustable device allows the users to set a desired torque that applies to the object so as to protect the object from being damaged by exceed torque.

However, the conventional torque adjustable sleeve assembly includes some disadvantages. The first disadvantage is that there is only one spring used in the assembly and the spring biases the body of the sleeve assembly, but the driving member is not directly biased by the spring. In other words, the body of the sleeve assembly and the driving member are not applied by an even force so that the force might not be applied on the central axis of the object and this affects the connection of the object to another object. The second disadvantage is that the only spring can only provide limited option when setting the torque which cannot meet the practical need. The third disadvantage is that the driving member and the body are made by metal which has high level of stiffness so that if an exceed torque is applied to the object, the object is easily damaged and the sleeve assembly is difficult to removed from the object.

The present invention intends to provide a torque adjustable sleeve assembly which includes two springs to provide the sleeve assembly and the driving member even force, and the two springs provide a wide range of options when setting the torques.

SUMMARY OF THE INVENTION

The present invention relates to a torque adjustable sleeve assembly which comprises a first part, a second part and an adjustable device. The first part includes an insertion hole and a connection hole in the first and second ends of the first part, wherein a bottom surface of the insertion hole having a series of first teeth annularly formed thereon and facing the second part. A first through hole is defined through a center of the first part and communicates the insertion hole with the connection hole. The second part includes a first end rotatably inserted into the insertion hole of the first part and includes a series of second teeth annularly formed on the first end and facing the first part for engaging with the first teeth. A second through hole is defined through a centre of the second part and communicates with a driving hole which is defined in a second end of the second part. Any one of inner diameters of the first and second through holes is relatively smaller than any one of inner diameters of the connection hole, insertion hole, and the driving hole.

The adjustable device includes a rod, a first spring, a second spring and at least one movable member, wherein the rod passes through the connection hole, the first through hole, the second through hole and is ended in the driving hole. A fixing member is connected to a first end of the rod and engaged with the connection hole to limit rotation of the rod relative to the first part. The at least one movable member is received in the driving hole and is movably connected to a second end of the rod. The first spring is mounted on the rod and biased between the fixing member and a bottom of the connection hole. The second spring is mounted on the rod and biased between the at least one movable member and a bottom of the driving hole. An engaging force between the first and second teeth is adjusted by moving the at least one movable member to set a desired torque that the sleeve assembly outputs.

Further benefits and advantages of the present invention will become apparent after a careful reading of the detailed description with appropriate reference to the accompanying drawings.

DETAILED DESCRIPTION OF THE INVENTION

Figures 1, 2:
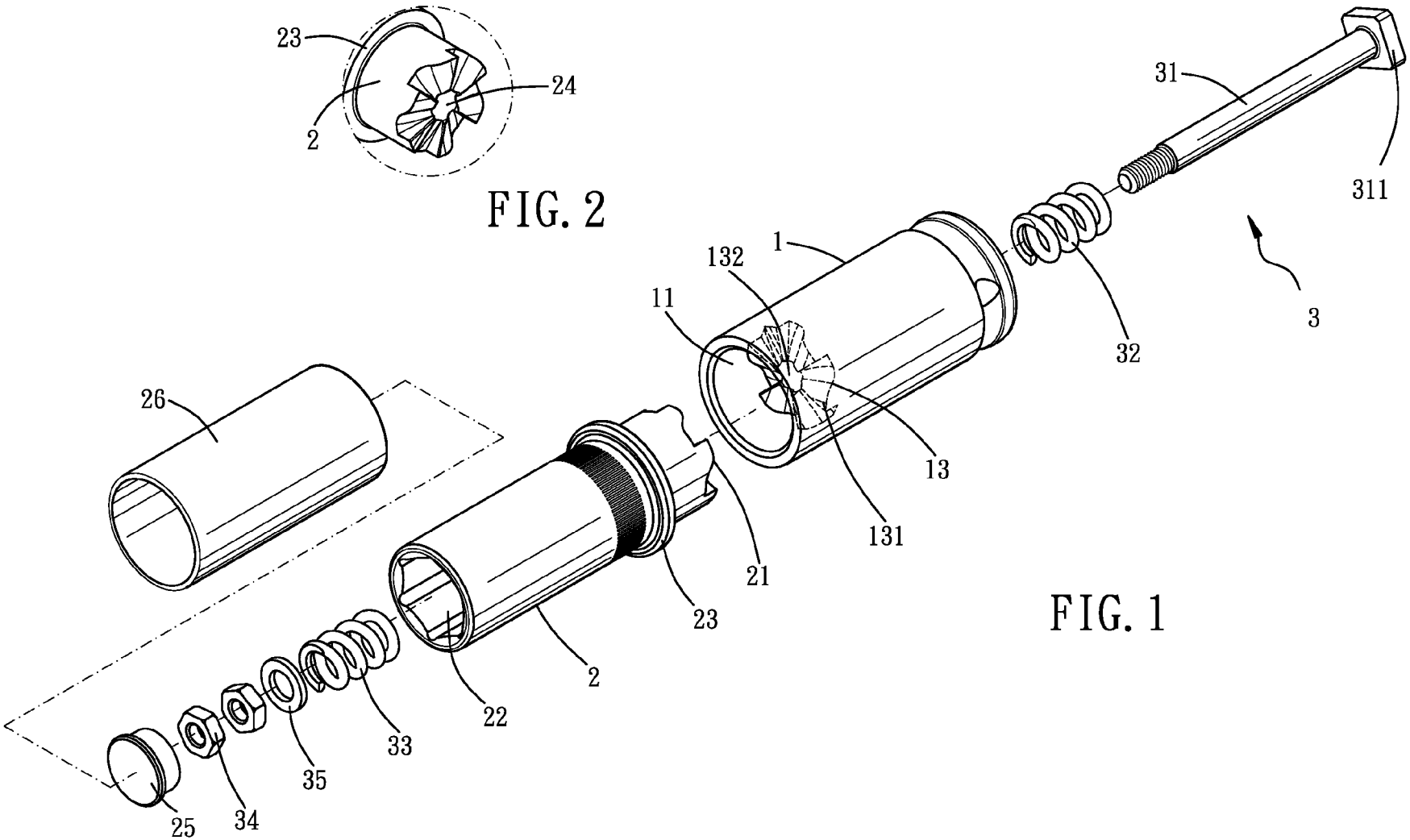
FIG. 1 is an exploded view to show the sleeve assembly of the present invention.
FIG. 2 is a perspective view to show the second teeth defined in the second part of the sleeve assembly of the present invention.
Figure 3:
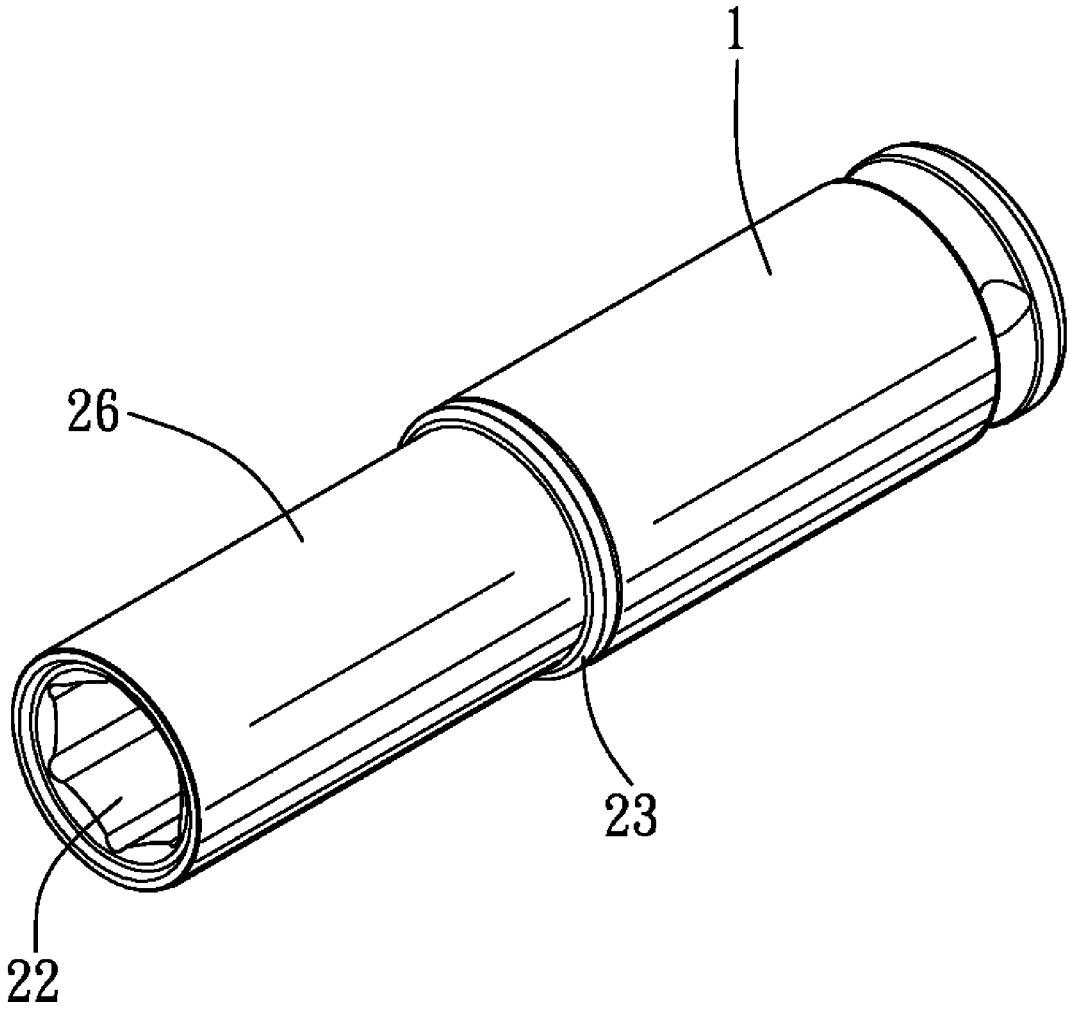
FIG. 3 is a perspective view to show the sleeve assembly of the present invention.
Figure 4:
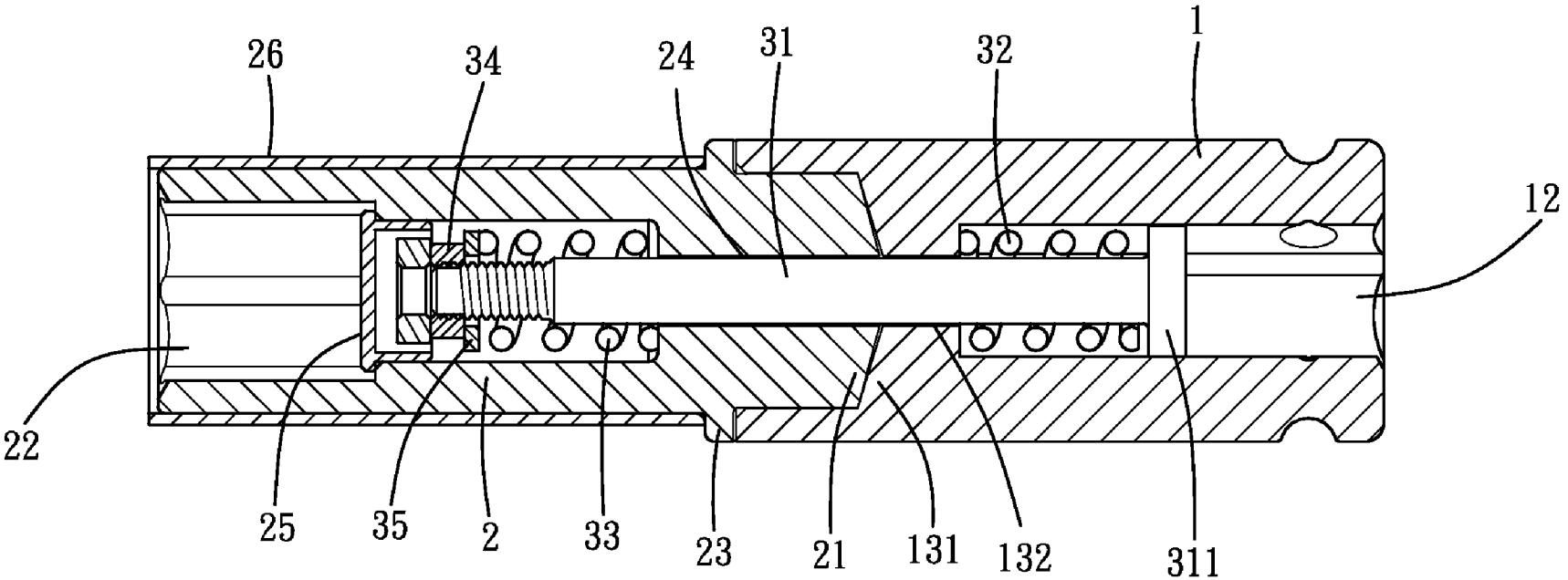
FIG. 4 is a cross sectional view to show the sleeve assembly of the present invention.

Referring to FIGS. 1 to 4, the torque adjustable sleeve assembly of the present invention comprises a first part 1, a second part 2 and an adjustable device 3. The first part 1 includes an insertion hole 11 defined in a first end thereof and a connection hole 12 defined in a second end of the first part 1 opposite to the first end. The connection hole 12 is a polygonal hole such as a rectangular hole so as to be connected with tool handle 4 or pneumatic tool 5 as disclosed in FIGS. 7 and 8 respectively. A bottom surface 13 of the insertion hole 11 has a series of first teeth 131 annularly formed thereon and facing the second part 2. A first through hole 132 is defined through a central axis of the first part 1 and communicates the insertion hole 11 with the connection hole 12.

The second part 2 includes a first end rotatably inserted into the insertion hole 11 of the first part 1. The second part 2 includes a series of second teeth 21 annularly formed on the first end thereof and facing the first part 1 for engaging with the first teeth 131. A second through hole 24 is defined in a central axis of the second part 2 and communicates with a driving hole 22 defined in a second end of the second part 2 opposite the first end. Any one of inner diameters of the first and the second through holes 132, 24 is relatively smaller than any one of inner diameters of the connection hole 12, the insertion hole 11, and the driving hole 22. The second part 2 includes a flange 23 extending outward and radially therefrom. The first end of the first part 1 abuts against the flange 23 for limiting a position of the first part 1 relative to the second part 2.

Figure 5:
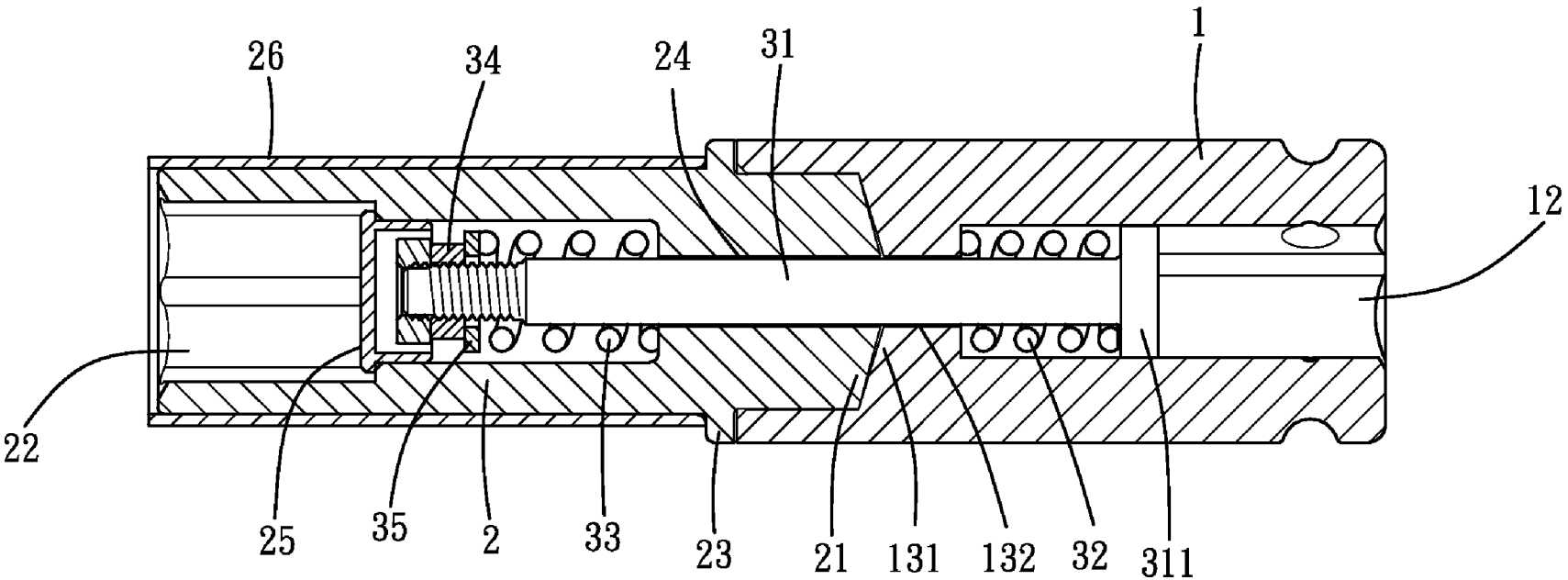
FIG. 5 is a cross sectional view to show that the movable member is threadedly moved to compress the springs of the sleeve assembly of the present invention.

The adjustable device 3 includes a rod 31, a first spring 32, a second spring 33 and two movable members 34. The rod 31 passes through the connection hole 12, the first through hole 132, the second through hole 24 and is ended in the driving hole 22. A rectangular fixing member 311 is connected to a first end of the rod 3 and is engaged with the connection hole 12 to limit rotation of the rod 31 relative to the first part 1. The movable members 34 are received in the driving hole 22 and are threadedly and movably connected to a threaded section (not numbered) at a second end of the rod 31 opposite to the fixing member 311. A washer 35 is mounted on the rod 31 and adjacent to the movable members 34. The first spring 32 is mounted on the rod 31 and biased between the fixing member 311 and a bottom of the first through hole 132. The second spring 33 is mounted on the rod 31 and biased between the washer 35 and a bottom of the driving hole 22. The first spring 32 is located in the first part 1 and the second spring 33 is located in the second part 2. An engaging force between the first and second teeth 131, 21 is adjusted by moving the movable members 34 related to the rod 31 as shown in FIG. 5.

The sleeve assembly further comprises a cap 25 located in the driving hole 22 and sealing the driving hole 22 for preventing the movable members 34 from detaching from the second end of the rod 31 and preventing foreign objects such as sands entering the driving hole 22. A tubular member 26 is rotatably mounted on the second end of the second part 2, and users can hold the tubular member 26 when operating the torque adjustable sleeve assembly.

Figure 6:
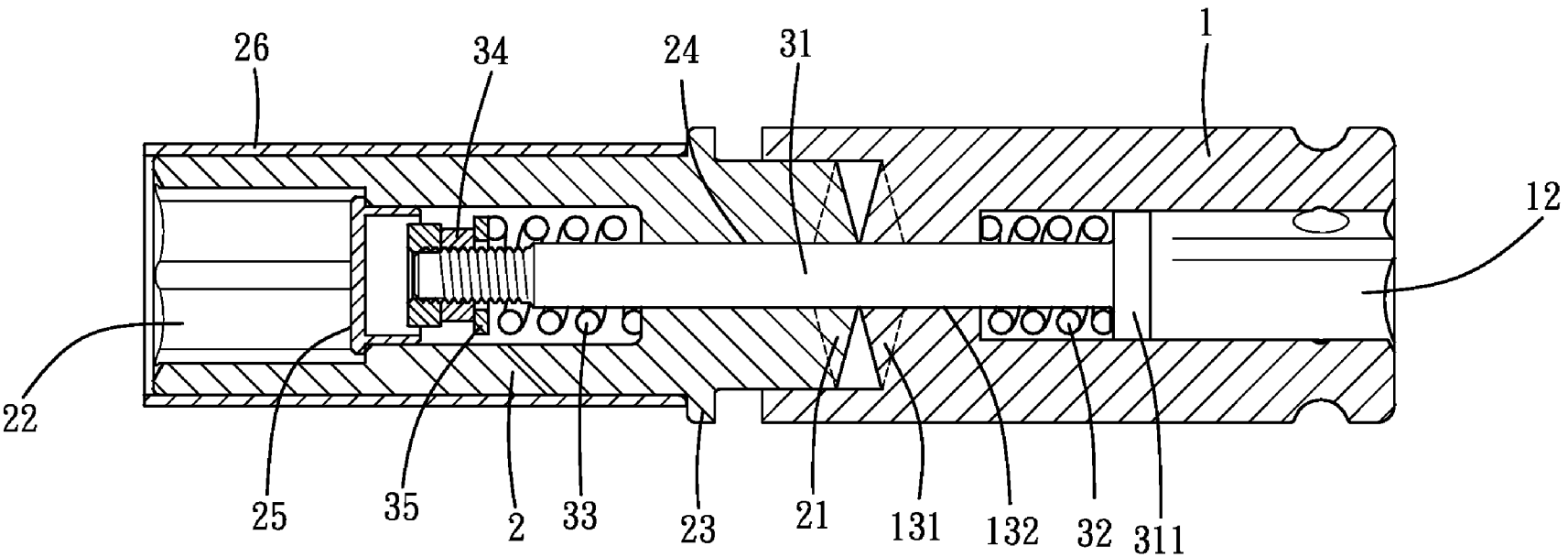
FIG. 6 is a cross sectional view to show that the first teeth move over the second teeth in operation.

When rotating the movable members 34 about the threaded section (not numbered), the first and second springs 32, 33 are both compressed or released to push or pull the first and second parts 1, 2, and the first and second parts 1, 2 are evenly applied by the first and second springs 32, 33. The engaging force developed by the first and second teeth 131, 21 can be preset by rotating the movable members 34 and forms a preset torque. When the driving hole 22 adapts to receive a tool bit or a screw unit for operation in a driving direction, and a torque from the tool handle 4 or pneumatic tool 5 exceeds the preset torque, the first teeth 131 cannot drive the second teeth 21 and will move over the second teeth 21 as shown in FIG. 6 so that the users are acknowledged that the preset torque is reached.

After finishing the work, the users simply adapt to remove the tool bit or the screw unit from the second part 2 in a reverse driving direction while the desired torque is still maintained, so that the users can access the tool bit or the screw unit again without resetting the torque.

Figure 7:
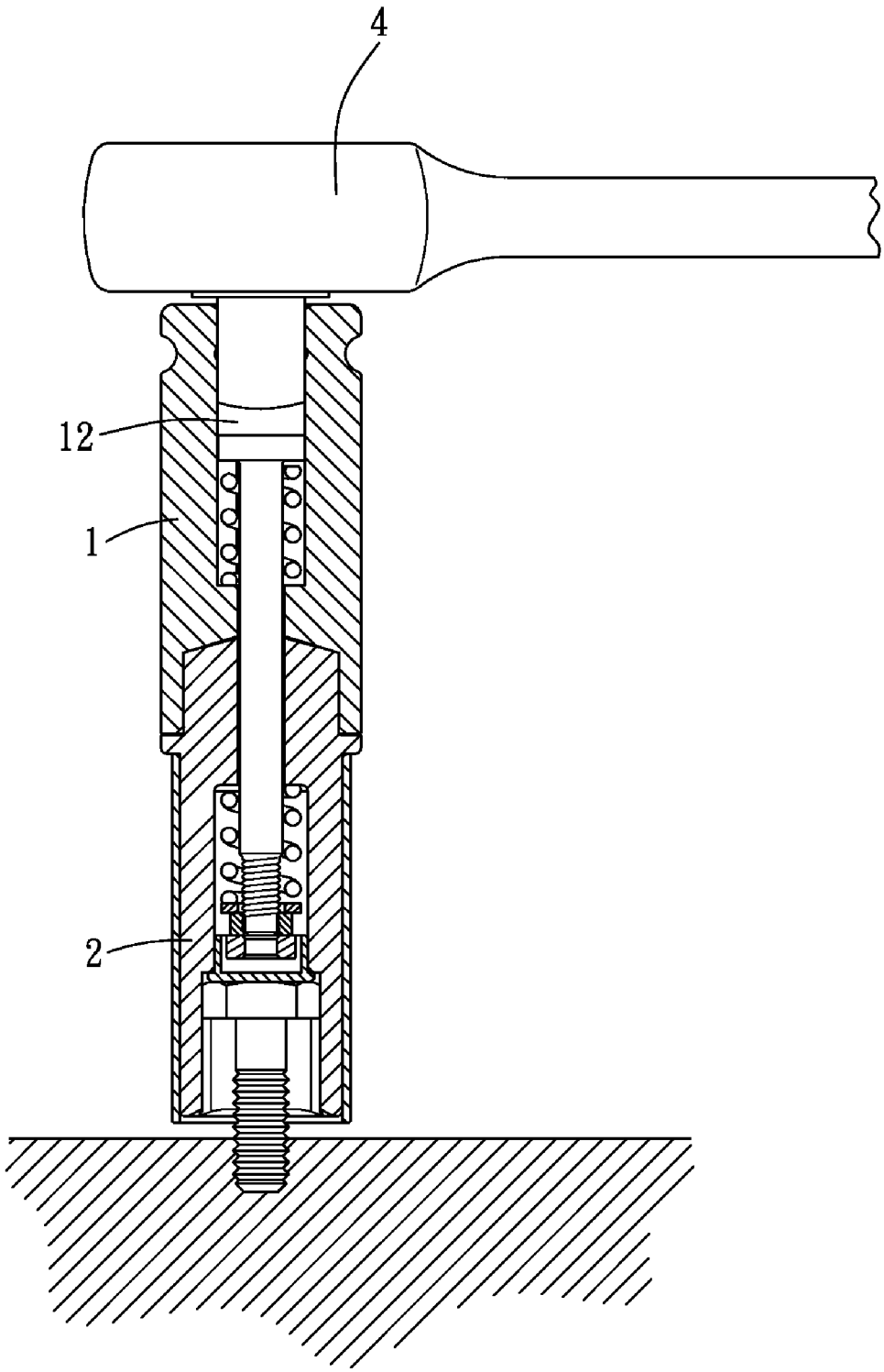
FIG. 7 is a cross sectional view to show that the first part is connected to and driven by a hand tool.
Figure 8:
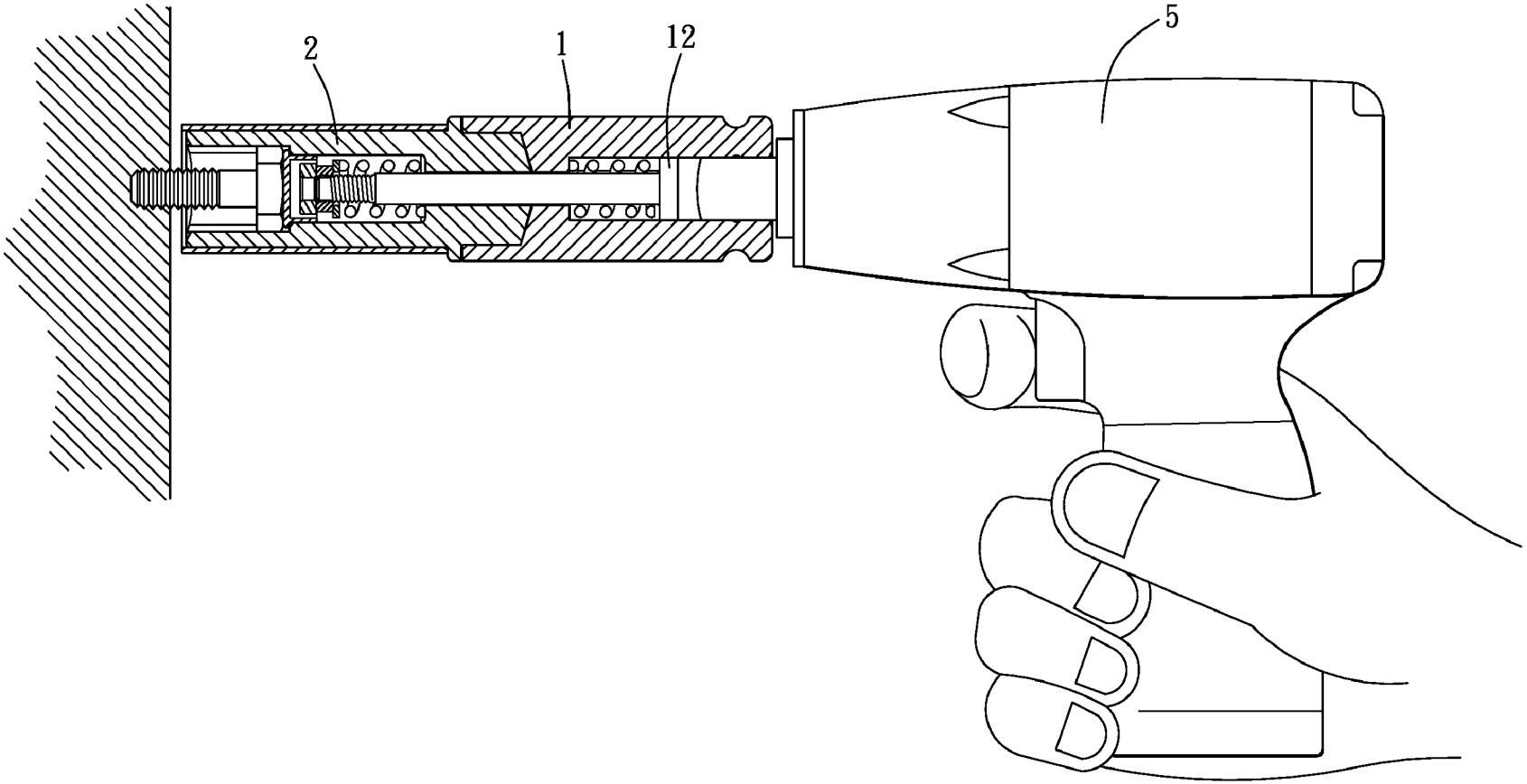
FIG. 8 is a cross sectional view to show that the first part is connected to and driven by a power tool.

Furthermore, it is also noted that the first part 1 is made of metal material and the second part 2 is made of plastic material, such that the second part 2 does not damage the tool bit or the screw unit the first part 1 is strong enough to bear the torque applied thereto from the hand tool 4 or power tool 5 as shown in FIGS. 7 and 8.

Although the invention has been explained in relation to its preferred embodiment, it is to be understood that many other possible modifications and variations can be made without departing from the spirit and scope of the invention as hereinafter claimed.

What is claimed is:

1. A torque adjustable sleeve assembly comprising:

a first part having an insertion hole defined in a first end thereof and a connection hole defined in a second end of the first part, a bottom surface of the insertion hole having a series of first teeth annularly formed thereon and facing a second part, a first through hole defined through a center of the first part and communicating the insertion hole with the connection hole;

the second part having a first end rotatably inserted into the insertion hole of the first part, the first end having a series of second teeth annularly fowled thereon, the second teeth facing the first part for engaging with the first teeth, a second through hole defined through a center of the second part and communicating with a driving hole defined in a second end of the second part, any one of inner diameters of the first and second through holes being relatively smaller than any one of inner diameters of the connection hole, insertion hole, and the driving hole; and an adjustable device including a rod, a first spring, a second spring and at least one movable member, the rod passing through the connection hole, the first through hole, the insertion hole, the second through hole and ended in the driving hole, a fixing member connected to a first end of the rod and engaged with the connection hole to limit rotation of the rod relative to the first part, the at least one movable member received in the driving hole and movably connected to a second end of the rod, the first spring mounted on the rod and biased between the fixing member and a bottom of the connection hole, the second spring mounted on the rod and biased between the at least one movable member and a bottom of the driving hole, an engaging force between the first and second teeth being adjusted by moving the at least one movable member related to the rod.

2. The assembly as claimed in claim 1, wherein the first part is made of metal material and the second part is made of plastic material.

3. The assembly as claimed in claim 1 further comprising a cap located in the driving hole and seals the driving hole for preventing the at least one movable member from detaching from the second end of the rod.

4. The assembly as claimed in claim 1, wherein the second part includes a flange extending outward and radially therefrom, the first end of the first part abutting against the flange for limiting a position of the first part relative to the second part.

5. The assembly as claimed in claim 1 further comprising a tubular member rotatably mounted on the second end of the second part.

6. The assembly as claimed in claim 1, wherein the connection hole and the fixing member are polygonal hole and polygonal member respectively.

* * * * *